United States Patent [19]

Garcia

[11] 4,199,141

[45] Apr. 22, 1980

[54] BASEBALL PITCHING SCORING APPARATUS

[76] Inventor: Abril I. Garcia, 16427 S. Brighton Ave., Gardena, Calif. 90247

[21] Appl. No.: 890,388

[22] Filed: Mar. 27, 1978

[51] Int. Cl.[2] ..... A63B 69/40

[52] U.S. Cl. ..... 273/26 A; 273/376

[58] Field of Search ..... 273/26 A, 29 A, 177 A, 273/177 B, 181 R, 181 J, 181 K, 35 R, 183 R, 102 R, 102 S, 102.1 R, 102.1 B, 102.1 C, 102.1 F, 102.2 R, 102.2 S, 127 R, 127 B, 103, 88, 1 E; 340/323 R

[56] References Cited

U.S. PATENT DOCUMENTS

| | | | |
|---|---|---|---|
| 1,523,747 | 1/1925 | Bradley | 273/102.2 R |
| 1,569,727 | 1/1926 | Donato | 273/102.2 R |
| 2,040,228 | 5/1936 | Whiteley | 273/26 A |
| 2,657,931 | 11/1953 | Burrell | 273/102.2 R |
| 3,133,733 | 5/1964 | Elseroad | 273/26 A |
| 3,206,196 | 9/1965 | Jackson | 273/26 A |
| 3,288,467 | 11/1966 | Rudolph | 273/181 R |
| 3,825,257 | 7/1974 | Palmer | 273/102.1 B |
| 4,029,315 | 6/1977 | Bon | 273/183 R |
| 4,070,018 | 1/1978 | Hodges | 273/102.1 R |

*Primary Examiner*—Richard C. Pinkham
*Assistant Examiner*—T. Brown
*Attorney, Agent, or Firm*—James E. Brunton

[57] ABSTRACT

An instructional and amusement device for teaching the art of correctly pitching a baseball, comprising a plurality of resilient target blocks mounted within contiguous support racks. When the apparatus is used as a training device, a pitched ball striking a target block will activate a mechanical switch adapted to close an electrical circuit to indicate, by audio and visual display means, either a "ball" or a "strike". Mounted at various locations within the blocks defining the normal "strike" zone, are a plurality of individual impact sensors comprising outwardly protruding plunger-type mechanical switching devices. When the apparatus is used also as an amusement device, a pitched ball striking one of these switching devices will close an electrical circuit, indicating by audio and visual means, either a "ball", "strike", "hit", "double", "triple", "homerun", "out", or "foul". These plunger type switches are stratigically located so that, by way of example, in the upper central portion of the strike zone will signal a "homerun". Scorekeeping during the game is performed by any convenient ancillary means.

10 Claims, 4 Drawing Figures

BASEBALL PITCHING SCORING APPARATUS

BACKGROUND OF THE INVENTION

1. Field of the Invention

This invention relates generally to physical education training and amusement type apparatus. More particularly the invention relates to an automatic baseball pitching-target device having a plurality of spaced apart target blocks and impact sensors which, when struck by a baseball, will indicate a corresponding "ball", "strike" or other result.

2. Description of the Prior Art

Various forms of baseball pitching-training devices have found use by both professional and amateur baseball pitchers, trainers and coaches during the history of the game, referred to by many as "America's favorite pastime". Some early devices, used primarily by sandlot or amateur ballplayers, involved pitching into stationary objects such as a wooden barrel, box or crate corresponding to an artificial "target" or "strike" zone. Later devices included other types of slightly more sophisticated pitching control practice aids. Many of these prior art devices, which included both mechanically and electronically actuated impact sensor means, were of little practical value and their functional capabilities were generally quite limited.

The following patents, which represent the most pertinent art known to applicant, clearly illustrate the novelty of Applicant's invention: U.S. Pat. Nos. 1,507,343; 2,059,365; 2,890,052; 3,133,733; and 3,229,975.

As will become apparent from the description which follows, the apparatus of the present invention overcomes many of the drawbacks inherent in the prior art devices and, for the first time, provides a highly useful, professional quality training device for teaching professional and amateur pitchers.

SUMMARY OF THE INVENTION

Applicant herein has conceived of an improved, fully automatic device for use in teaching baseball pitching. The device can be operated both in a "training" mode and in a "game" mode. In the "game" mode the device takes on the character of an amusement, as well as an instructional device.

As a simple instructional device, the invention provides a pitching target having a field of balls and strikes. The "strike" zone is equal in width to the size of the regulation baseball homeplate and is approximately three feet in height, corresponding to the height of the strike-zone of an average adult batter. In the embodiment of the invention shown in the drawings, several resilient target blocks are mounted on the front of each of three separate portable racks. The central portion of the center rack contains the blocks corresponding to the "strike" zone, while the high and low target blocks correspond to, and register a "ball" when impacted by a thrown pitch. The two side racks each have target blocks which also correspond to and register a "ball" when struck by a pitched ball. The target blocks are arranged to actuate mechanical switches which are adapted to close an electrical circuit energizing display means which provide audio and visual indications of the accuracy of the pitched ball.

As an amusement device, the apparatus of the invention may be operated in a "game" mode and will provide an audio and visual indication of either a "ball", "strike", "hit", "double", "triple", "homerun", "out", or "foul" depending upon which locations within the normal "strike" zone are impacted by a pitched ball. To sense the precise location of impact of the pitched ball, the target blocks within the "strike" zone are provided with a plurality of outwardly protruding target elements operably interconnected to switches adapted to close an electrical circuit to actuate audio and visual means which indicate the precise impact point and accuracy of the pitched ball. Scorekeeping during the "game" mode may be accomplished by the contestants or by any convenient ancillary means.

The support racks are adapted to carry the display means which comprise back lighted sign panels designed to provide a visual indication of the impact area and accuracy of each pitched ball. An audio indication may also be provided by means of a tape recorder or the like. The three racks are mechanically and electronically interconnected in a manner well known to those skilled in the art and are mounted on casters or rollers for ease of movement. The device embodies standard, commercially available electrical components and can be operated either from a standard A.C. power source or from batteries.

It is an object of the present invention to provide a fully automatic apparatus for use in training baseball pitchers in which the location of impact of the baseball upon a target area simulating a strike zone is accurately indicated.

It is another object of the invention to provide an apparatus of the aforementioned character in which there is provided audio and visual indications of either a "ball" or a "strike" corresponding to each pitch thrown by the trainee.

It is a further object of the invention to provide an apparatus of the type described in the preceeding paragraphs which is also capable of indicating by audio and visual means a "strike", "ball", "foul", "hit", "double", "triple" or "homerun" for each pitch thrown in the area of the strike zone.

It is another object of the invention to provide an apparatus as described which is capable of repeatedly withstanding the force of a baseball thrown at speeds up to one hundred miles per hour.

It is another object of the invention to provide an apparatus of the aforementioned character which causes a pitched ball to be returned to the player after striking the resilient surface of a target block.

It is another object of the invention to provide an apparatus as described in the preceeding paragraphs which is highly accurate and reliable and can be used for teaching amateur as well as professional pitchers.

It is still another object of the invention to provide an apparatus of the character described which can be used both as an instructional device and as an amusement device.

DESCRIPTION OF ONE EMBODIMENT OF THE INVENTION

Figure 1:
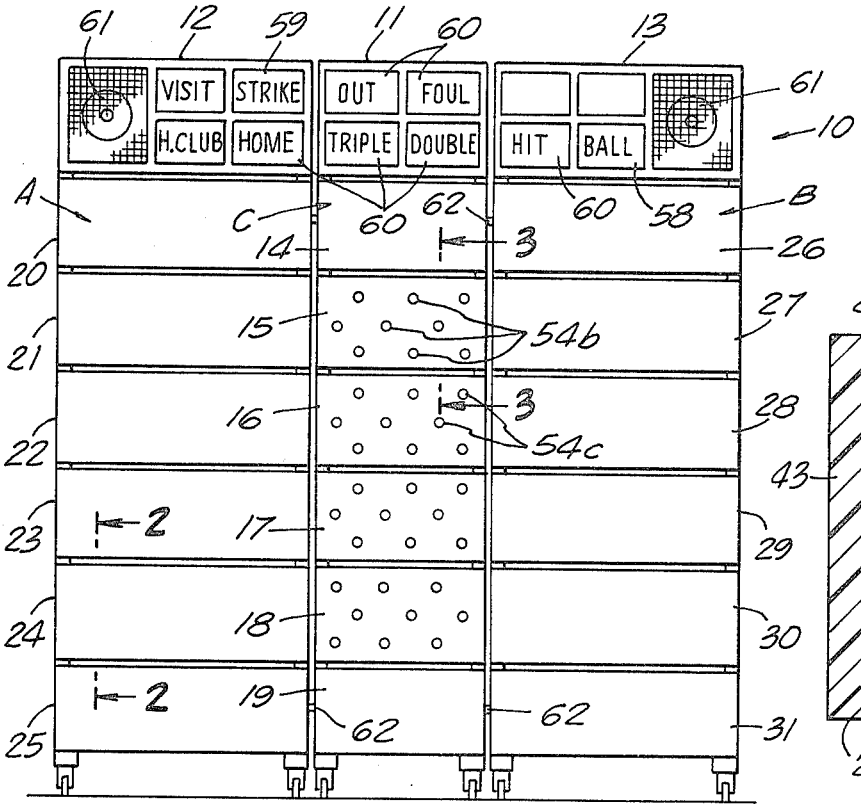
FIG. 1 is a front view of one embodiment of the apparatus of the invention.

Referring to the drawings and particularly to FIG. 1, the apparatus of the invention is generally designated by the numeral 10. This apparatus, which is principally used for teaching a trainee the art of correctly pitching a baseball, includes first, second and third target zones designated A, B and C respectively. Each target zone is made up of a plurality of vertically spaced apart impact sensor means for sensing the impact of a pitched baseball thereupon. In one embodiment of the invention shown in the drawings, these impact sensor means are carried by a center support rack 11 and side support racks 12 and 13. Racks 11, 12 and 13 are each mounted on casters for ease of portability and may be constructed from any of several suitable materials including aluminum, steel, wood or plastic.

Referring to the central portion of FIG. 1, it can be seen that target zone C is circumscribed by center rack 11 which is adapted to carry second and third impact sensor means. In this form of the invention the second impact sensor means comprise resilient second target blocks 14, 15, 16, 17, 18 and 19. In a manner presently to be described, these second target blocks carry the third impact sensor means which comprise a plurality of outwardly extending reciprocally movable target elements. Target blocks 15, 16, 17 and 18 of target zone C represent the "strike" zone which is the principal target of a pitcher using this device 10. The total height of this strike zone is on the order of three feet which corresponds to the height of the strike zone for a typical average adult baseball player. The width of target blocks 14, 15, 16, 17, 18 and 19 is equal to the width of a regulation-size home plate and thus defines the width of the strike zone. Target blocks 14 and 19 represent part of the "ball" zone since they are respectively located above and below the "strike" zone.

The first and second target zones A and B of the apparatus are circumscribed by side support racks 12 and 13. These racks are similar in construction to rack 11 and are adapted to carry first impact sensor means shown in this form of the invention as resilient first target blocks 20, 21, 22, 23, 24 and 25, carried by rack 12 and resilient target blocks 26, 27, 28, 29, 30 and 31 carried by rack 13. Target zones A and B represent the remainder of the "ball" zone.

Figure 2:
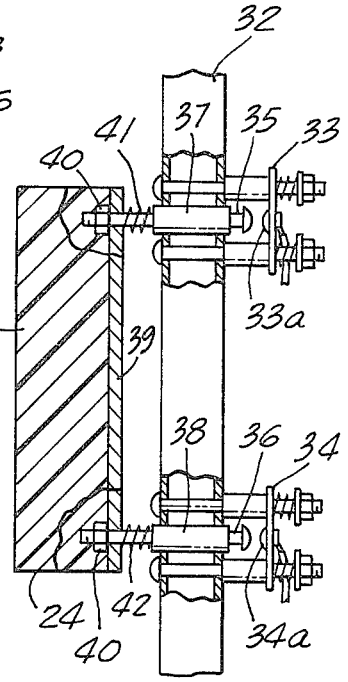
FIG. 2 is an enlarged fragmentary cross-sectional view taken along lines 2—2 of FIG. 1 illustrating the construction of one of the impact sensor means of the apparatus.

In FIG. 2 there is shown a cross-sectional view of a first target block 24, which is typical of all of the first target blocks in target zones A and B. Also shown in FIG. 2 are first switch means which comprise a part of the first display means of the invention for indicating to the senses of the trainee the impact of a baseball on one of the first target blocks. In this embodiment of the invention the first switch means include upper and lower mechanical switches 33 and 34, mounted by any convenient means to frame member 32. Switches 33 and 34 comprise stationary switch terminals 33*a* and 34*a* carried by frame 32 and cooperating movable terminals shown here in the form of rods 35 and 36, respectively. Rods 35 and 35 are slidably mounted in cylindrical guide members 37 and 38 and are rigidly connected to plate 39 of target block 24 by any convenient fastener, such as that shown at 40. First biasing means provided in the form of springs 41 and 42 are employed to return block 24 to its normally outward position after being briefly compressed due to the resulting force caused by a pitched ball striking the target block 24. The front section 43 of block 24 is a resilient cushion which may be made from any suitable yieldably resilient material such as rubber, plastic or sponge to facilitate the return of a pitched ball to the player.

Figure 3:
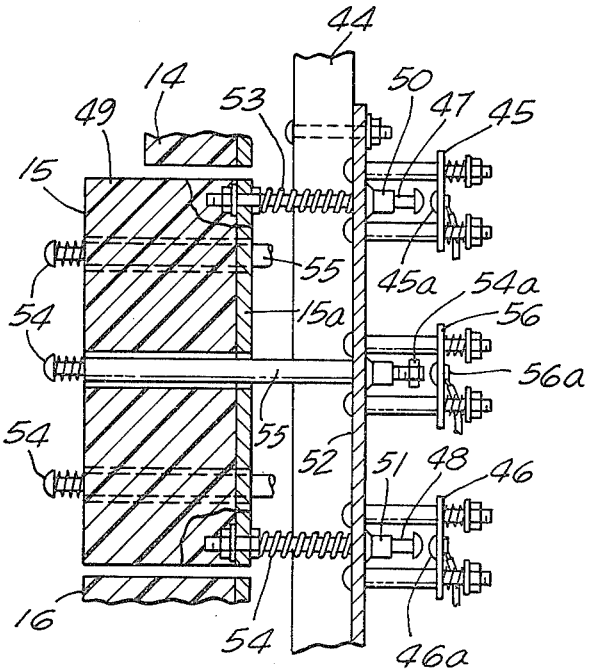
FIG. 3 is a cross-sectional view similar to FIG. 2 taken along lines 3—3 of FIG. 1 illustrating the construction of another type of impact sensor means.

In FIG. 3 there is shown a sectional view of second target block 15 which is typical of the four target blocks 15, 16, 17 and 18 defining the "strike" zone. FIG. 3 also shows vertical supporting member 44 of rack 11 and second and third switch means which comprise parts of the second and third display means of the invention for indicating to the senses of the trainee the impact of a pitched baseball on the second target blocks and the outwardly protruding target elements. In this embodiment of the invention the second switch means comprise mechanical switches 45 and 46. Switches 45 and 46 have stationary terminals 45*a* and 46*a* and movable terminals comprising rods 47 and 48 slidably mounted within cylindrical guide members 50 and 51 respectively which are attached to fixed plate 52 carried by member 44. The forward ends of rods 47 and 48 are connected to plate 15*a* of block 15. Second biasing means in the form of springs 53 and 54 bias the target block 15 to its normally outward position after being briefly compressed due to the resulting force caused by a pitched ball striking target block 15. The operation of target block 15 is thus far similar to the operation of target block 24. However, mounted at various positions within target block 15 are the previously mentioned third sensor means which, in this embodiment comprise a plurality of outwardly protruding target elements or rods 54. As seen in FIG. 3, rods 54 are slidably mounted within cylindrical guides 55 carried within resilient member 49 of block 15. Third switch means 56, which form a part of the third display means of the invention for indicating the impact of a pitched ball on the target elements 54, comprise fixed terminals 56*a* mounted on plate 52. In this form of the invention, the movable terminals of switch means 56 comprise the rearward extremities 54*a* of target elements 54. It is to be understood that target elements or rods 54 are located in various positions within each of the target blocks 15, 16, 17 and 18 of the strike zone.

Each target element 54 may be color-coded and is located in a position which when hit is known to correspond to the result achieved by a skilled baseball batter who received a pitch to that respective position. For example, a pitch which strikes a red-colored element 54*b* located in the upper center of the "strike" zone will produce a homerun indication by the third display means. This, of course, is to be avoided by the pitcher when operating device 10 in its "game" mode. Other colored target elements 54 in other locations will correspond to and produce known indications of "hit", "double", "triple", "foul", or "out" when operating in the game mode. For example, the target elements indicated by the numeral 54*c* may be green in color and when hit by a pitched ball will indicate a "double" on the third display means. In either the "game" or "training" mode, a pitched ball striking the "ball" zone A or B will register as a "ball" on the first display means and a pitched ball striking between the target elements in the blocks in the "strike" zone C will register as a "strike" on the second display means.

In this form of the invention the means for indicating the accuracy of a pitched ball comprises the previously mentioned first, second and third display means.

In addition to the switch means already described, each of the first, second and third display means comprises electrically operated signal means in the form of audio signals and lighted panels bearing various indicia. These signal means are interconnected with the switch means by electric circuit means for operating the signal means upon actuation of a particular switch by the impact of a pitched ball. For example, the first switch means are electrically interconnected with a first lighted panel 58 bearing the indicia "ball" and with audio means which audiblize the word "ball". The second switch means are electrically interconnected with a second lighted panel 59 bearing the indicia "strike" and with audio means which audiblize the word "strike". The third switch means, which are associated with the reciprocally movable target elements, are electrically interconnected with third lighted panels 60 bearing various indicia such as "hit", "out", "double", "triple", "foul ball" and the like and with audio means to correspondingly audiblize the words. The audio system may be of any suitable type such as tape recorder which produces a verbal word such as "strike" or "ball" over loud speakers 61 carried by support racks 12 and 13. The lighted panels may consist of any convenient colored transparent back-lighted signs which produce an indication as described herein and as shown at the upper portions of support racks 11, 12 and 13.

Figure 4:
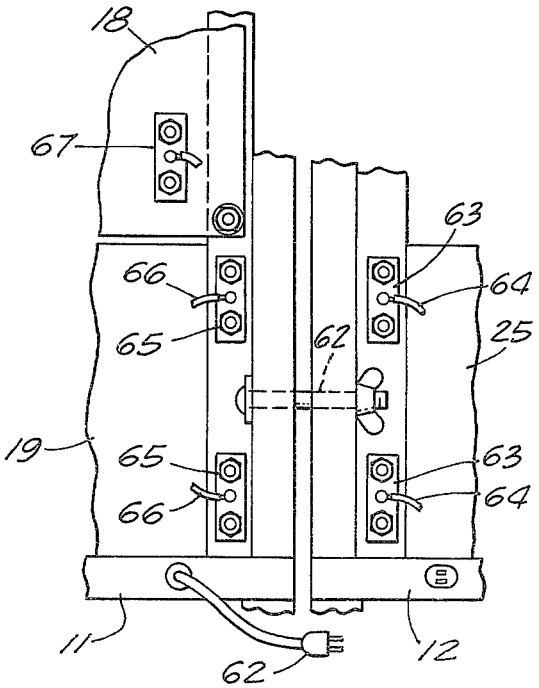
FIG. 4 is an enlarged fragmentary view of the back of the apparatus.

FIG. 4 illustrates the method of electrical interconnection of the previously identified mechanical switches of the switch means and the manner and ease with which rack 11 may be interconnected with racks 12 or 13. Wing nut and screw assembly 62 are typical of the means used for the mechanical connection. The switches shown in this figure, and identified by the numeral 63, comprise a part of the first switch means of the invention and are electrically interconnected by wires 64 with lighted panel 58 and the audio means which audiblized the word "ball". The switches shown in FIG. 4 designated 65 comprise a part of the second switch means of the invention and are electrically interconnected by wires 66 with lighted panel 59 and the audio means which audiblizes the word "strike". Switch 67 comprises one of the switches which forms a part of the third switch means of the invention. This switch is actuated by a pitched ball striking one of the target elements which protrude outwardly from the strike zone. Depending upon the location of the switch within the strike zone, it may be interconnected by wire 67 with one of the lighted panels 60 and with the audio means which audiblizes the corresponding word "triple", "double", "foul", etc.

The audio and visual circuitry of the apparatus is of a standard type well known to those skilled in the art of electronics. Power for operating the apparatus may be supplied through a standard 110 v. A.C. plug and cord as shown in 62, or it may be battery operated.

OPERATION

In operation of the apparatus only the first and second impact sensor means and associated first and second display means may be energized whereby only "strikes" and "balls" will be indicated. Alternatively, the third sensor means may also be energized to place the apparatus in the "game" mode, whereby "hits", "outs", "doubles", "homeruns" and the like will be indicated.

With the apparatus in either the "training" or "game" mode, a pitched baseball striking the target blocks disposed within target zones A and B will actuate the first switch means causing illumination of the lighted panel bearing the indicia "ball" and, if desired, simultaneous actuation of the audio means which will audiblize "ball". A pitched ball impacting within target zone C and striking target blocks 14 and 19 will also cause an indication by the display means of a "ball". A pitched ball impacting within the "strike" zone of target zone C may strike either an individual target element 54 or it may miss the target elements and strike the face of one of the target blocks 15, 16, 17 or 18. In the latter case, a second switch means will be actuated which will cause lighted panel 59 to be illuminated indicating a strike. If desired the audio means can also be energized so that the closing of the second switch means will result in the word "strike" being audiblized.

If the pitched ball is high and strikes a target element **54*b*, the third switch means will be actuated and the lighted panel 60 indicating a "homerun" will be illuminated. Similarly, if a target element 54*c* is struck, the panel 60 indicating a "double" will be illuminated. In like fashion the ball striking other elements 54** will result in an indication of a "triple", a "foul", or the like depending upon how the apparatus is electrically wired. If desired, the third audio means can also be energized to give an audible indication of a particular target element being impacted.

Having now described the invention in detail in accordance with the requirement of the patent statues, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An apparatus for use as an instructional aid in teaching a trainee how to accurately pitch a baseball, or the like, comprising:

(a) first and second target zones, including:
  (1) first and second supporting racks;
  (2) a plurality of vertically spaced apart first target blocks carried by said first and second supporting racks for reciprocal movement with respect thereto in responce to being impacted by a pitched baseball; and
  (3) biasing means for yieldably resisting reciprocal movement of said first target blocks;

(b) first display means operably interconnected with said first target blocks for indicating to the senses of the trainee the impact of a pitched baseball thereupon, including:
  (1) an electrically operated first lighted panel bearing the indicia "ball";
  (2) first switch means actuated by reciprocal movement of said first target blocks; and
  (3) electrical circuit means interconnecting said first lighted panel and said first switch means for lighting said panel upon actuation of said first switch means;

(c) a third target zone disposed intermediate said first and second target zones including:
  (1) a third supporting rack;
  (2) a plurality of vertically spaced apart second target blocks carried by said third supporting rack; and
  (3) biasing means for yieldably resisting reciprocal movement of said second target blocks;

(d) second display means operably interconnected with said second target blocks for indicating to the senses of the trainee the impact of a pitched baseball thereupon, including:
(1) an electrically operated second lighted panel bearing the indicia "strike";
(2) second switch means actuated by reciprocal movement of said second target blocks; and
(3) electrical circuit means interconnecting said second lighted panel and said second switch means for lighting said second panel upon actuation of said second switch means;
(e) a plurality of target elements carried by said second target blocks for reciprocal movement with respect thereto;
(f) third display means operably interconnected with said target elements for indicating to the senses of the trainee the impact of a pitched baseball thereupon including:
(1) a plurality of electrically operated third lighted panels bearing various indicia;
(2) a third switch means actuated by reciprocal movement of said target elements; and
(3) electrical circuit means interconnecting said third lighted panels and said third switch means for lighting one of said third lighted panels upon actuation of said third switch means.

2. An apparatus as defined in claim 1 in which said first and second target blocks are formed of a resilient material adapted to cause a pitched baseball to rebound toward the trainee.

3. An apparatus as defined in claim 1 in which said first, second and third display means each include audio means operably interconnected with said first, second and third switch means for audibly indicating the impact of a pitched ball against said first target block, said second target block and said target elements respectively.

4. An apparatus as defined in claim 1 in which said first and second switch means each comprise a plurality of mechanical switches having a stationary switch terminal carried by said first and second supporting racks and a cooperating movable switch terminal carried by said first and second target blocks.

5. An apparatus as defined in claim 4 in which said third switch means comprise a plurality of mechanical switches having a stationary switch terminal carried by said third supporting rack and a cooperating movable terminal connected to and movable with said target elements.

6. An apparatus as defined in claim 5 in which said third lighted panels are variously colored and in which each said target element is colored to correspond with the color of said lighted panel with which said target element is operably associated.

7. An apparatus for use in teaching a trainee the art of baseball pitching, comprising:
(a) first and second target zones each having a plurality of first impact sensor means for sensing the impact of a pitched baseball thereupon;
(b) first display means operably interconnected with said first impact sensor means for indicating to the senses of the trainee the impact of a baseball upon one of said first impact sensor means;
(c) a third target zone disposed intermediate said first and second target zones, said third target zone comprising:
(1) a plurality of vertically spaced apart reciprocally movable second impact sensor means for sensing the impact of a pitched ball thereupon;
(2) biasing means for yieldably resisting reciprocal movement of said second impact sensor means;
(3) second display means operably interconnected with said second impact sensor means for indicating to the senses of the trainee the impact of a baseball upon one of said second impact sensor means;
(4) a plurality of target elements carried by said second impact sensor means for reciprocal movement with respect thereto; and
(5) third display means operably interconnected with said target elements for indicating to the senses of the trainee the impact of a baseball thereupon.

8. An apparatus as defined in claim 7 in which said first and second impact sensor means respectively comprise a plurality of spaced apart first and second target blocks adapted to be yieldably deformed by the impact thereupon of a pitched baseball, in which said target elements are reciprocally carried by said second target blocks.

9. An apparatus as defined in claim 8 in which said first and second display means comprise a plurality of first and second switch means adapted to be actuated respectively by yieldable deformation of said first and second target blocks.

10. An apparatus as defined in claim 9 in which said third display means comprises a plurality of third switch means adapted to be actuated by reciprocal movement of said target elements.

* * * * *